US005461351A

United States Patent [19]

Shusterman

[11] Patent Number: 5,461,351

[45] Date of Patent: Oct. 24, 1995

[54] COMMON-MODE FILTERING ATTACHMENT FOR POWER LINE CONNECTORS

[76] Inventor: Boris Shusterman, 44 White Ave., Newton, Mass. 02159

[21] Appl. No.: 254,101

[22] Filed: Jun. 6, 1994

[51] Int. Cl.[6] ..... H01R 13/658

[52] U.S. Cl. ..... 333/181; 333/185; 174/35 C; 439/607

[58] Field of Search ..... 333/12, 181, 182, 333/185; 439/607; 336/175; 174/32, 35 C

[56] References Cited

U.S. PATENT DOCUMENTS 4,519,664 5/1985 Tillotson ..... 333/12 X 5,304,964 4/1994 DiMarco ..... 333/181

*Primary Examiner*—Paul Gensler

*Attorney, Agent, or Firm*—Denis G. Maloney; Arthur W. Fisher

[57] ABSTRACT

A filtering attachment is provided for the reduction of common-mode noise in systems. The filtering attachment includes a connector, a ferrite fitted around the connector and a conductive bracket which serves to secure the ferrite around the connector as well as comprising a shunting capacitance for increased filtering.

8 Claims, 2 Drawing Sheets

COMMON-MODE FILTERING ATTACHMENT FOR POWER LINE CONNECTORS

BACKGROUND OF THE INVENTION

This invention relates generally to filtering of electromagnetic interference (EMI) and more particularly to the filtering of common-mode noise in products where noise couples into power lines.

As is known in the art any piece of equipment carrying an electric current is a possible source of electro-magnetic interference (EMI). Electronic devices may experience operating difficulties when subjected to EMI. In order to make electronic devices reliable and compliant with various standards it is desirable to reduce EMI to a minimum.

EMI can be viewed as any electromagnetic disturbance which results in the malfunctioning of an electronic device or interference to an electronic device. This disturbance may occur in three different ways namely through interference generation, interference transmission or interference susceptibility. EMI can be generated by varying electric or magnetic fields. The more abrupt the variation in energy flow, the broader the frequency range of the generated interference. Potential sources of interference are switches, relays, motors and transmitters. Once the interference is generated it may be transmitted from the source to an electronic device by free space radiation, inductive or magnetic field coupling, capacitive or electric field coupling, a common conductive or capacitive impedance, or any combination thereof. Susceptible electronic devices may be exposed to the generated interference by input conductors to the device.

One way of controlling EMI is to suppress the interference by use of a filter. It is desirable to provide the amount of suppression required with a minimum increase in the weight, bulk, space, complexity and cost of the assembly the filter will be part of. The purpose of filtering EMI is to attenuate by blocking or bypassing interference present on a line in order to prevent the interference from reaching the electronic devices. Filtering is often provided by introducing a high impedance into the path of the interfering currents, by shunting the interfering currents to ground through a low impedance, or a combination of both.

Common-mode noise is a type of EMI that is generated by sources such as fast switching of poorly terminated logic circuits, the oscillation of diodes of a power converter during transition, or poorly placed clock drivers. The common-mode characteristic of the noise means that the noise is passing through power lines in phase, with the return being the chassis of the enclosure housing the electronic components.

One technique used in the art to reduce common-mode noise is to surround the electrical conductors of the signal transmission path with a substance such as a ferrite material which can absorb undesired harmonics. As an example, for a single phase A.C. line application, the line and neutral conductors are wound bifilar (side by side) on a toroid. The resulting common-mode impedance serves to attenuate the common-mode noise traveling through the electrical conductors. This implementation however suffers from several disadvantages. The toroid has to be positioned on the electrical conductors between the power connector and the remainder of the circuit. Placing the toroid further away from the connector would result in the possibility of noise coupling into the electrical conductors making the design less effective, thus the toroid needs to be positioned close to the A.C. connector. The other disadvantage of this type of filter assembly is that at low frequencies the impedance of the filter is determined by the inductance of the toroid. Having a high number of turns is beneficial as the inductance is proportional to the square of the number of turns. Having situations where two or more turns are desired the required toroid becomes very large in order to handle two or more turns of the electrical conductors which are wrapped around the ferrite. The resulting toroid and wire loops take up valuable real estate inside the enclosure, as well as requiring an assembly process to wind the conductors on the toroid.

SUMMARY OF THE INVENTION

In accordance with the present invention a filtering attachment for the reduction of common-mode noise includes a connector having at least two electrical conductors, a ferrite fitted around the connector and a conductive bracket disposed about the ferrite which serves to secure the ferrite around the connector as well as producing shunting capacitances for increased filtering. The ferrite may be integrated as part of the connector or may be a separate part which is positioned around the connector. With such an arrangement the EMI coming into the system via a cable or cord attached to the connector would enter the filter and be attenuated in two manners. First the conductive bracket and conductor, spaced by the ferrite provide a capacitor which bypasses high frequency currents to the chassis while blocking them from the input lines. Additionally the inductors produced by the common-mode inductance of the ferrite serve to attenuate A.C. currents as the inductor fluxes cancel each other for normal DC currents. An additional benefit of having the ferrite and the conductive bracket disposed about the connector is that this arrangement reduces the amount of space typically required by previous filtering implementations which required the toroid be placed close to the connector while also having the electrical conductors wound around the toroid as well as removing the manufacturing step of winding the conductors around the ferrite toroid.

DESCRIPTION OF PREFERRED EMBODIMENTS

Figure 1:
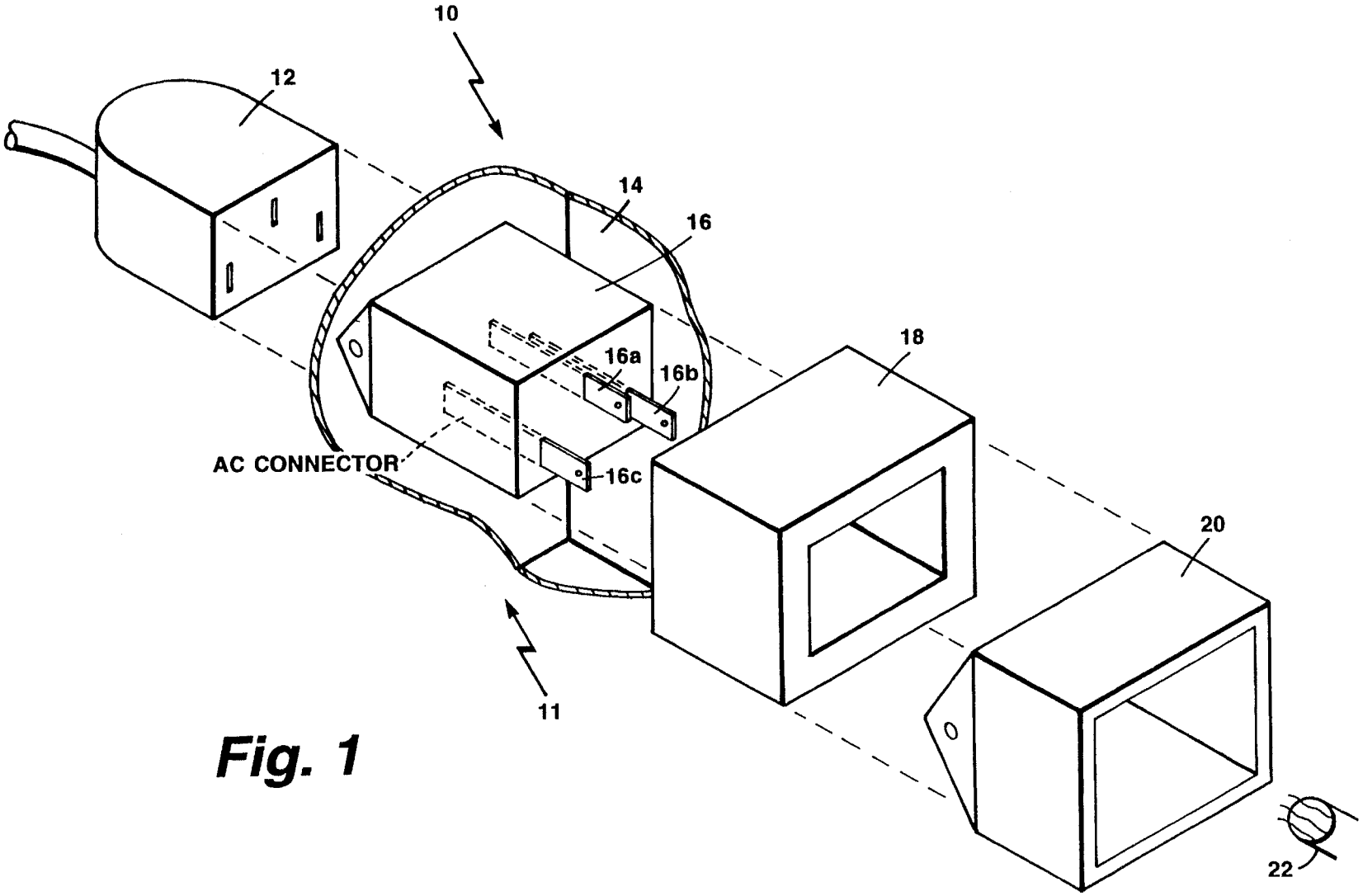
FIG. 1 is an exploded view of a portion of a cabinet having a power line connector and the common-mode filter.

Referring now to FIG. 1, an electrical apparatus 10 is shown to include a common-mode filter 11 used to filter undesired electromagnetic interference for an A.C. power line 12 connected to the apparatus 10. The common-mode filter 11 is shown to include an A.C. connector 16 mounted to the inside of a system enclosure 14. The A.C. connector 16 is secured to the system enclosure 14 by screws, rivets, clips or any available means of connecting this type of connector to a system enclosure. A shaped ferrite toroid 18 is disposed around the A.C. connector 16, and a conductive cover 20 is then placed over the ferrite toroid 18 and serves to secure the ferrite toroid 18 in place about the A.C. connector 16. The conductive cover 20 is attached to the system enclosure 14 by screws, rivets or any other attachment means that provide for an electrical path from the conductive bracket 20 to the system enclosure 14.

Wire harness 22 is connected to connector conductors 16*a*, 16*b*, and 16*c* with each wire of harness 22 connected individually to a respective connector conductor 16*a*, 16*b*, or 16*c*.

The ferrite toroid 18 is composed of a nickel-zinc oxide or any other material or combination of materials which have the property of absorbing undesired harmonics by having the ferrite toriod's maximum impedance at the frequency of the noise intended to be filtered. The shape of the ferrite toroid 18 in this implementation is rectangular, although any other shape that produces the desired attenuation may be used. Preferably the shape of the ferrite toroid 18 matches the shapes of the connector 16 and preferably the shape of the bracket 20 in order to provide a shunting capacitance.

The placement of the ferrite toroid 18 around the A.C. connector 16 produces the equivalent of a common-mode choke with the electrical conductors making one turn around the ferrite toroid 18 and serves as a series impedance to any EMI that may be present. This alone produces a single pole filter having a useable degree of filtering. The addition of the conductive bracket 20 serves to further increase the filtering. The conductive bracket 20, besides it use as a securing device for the ferrite toroid 18 around the A.C. connector 16, preferably also serves as part of the filtering circuit. By connecting the conductive bracket 20 to chassis ground, the conductive bracket 20, the ferrite toroid 18, and the A.C. connector conductors 16*a*, 16*b* and 16*c* provide a plurality of high frequency capacitors which provide a shunting impedance to any EMI that may be present. In this manner a two pole filter is provided.

Figure 2:
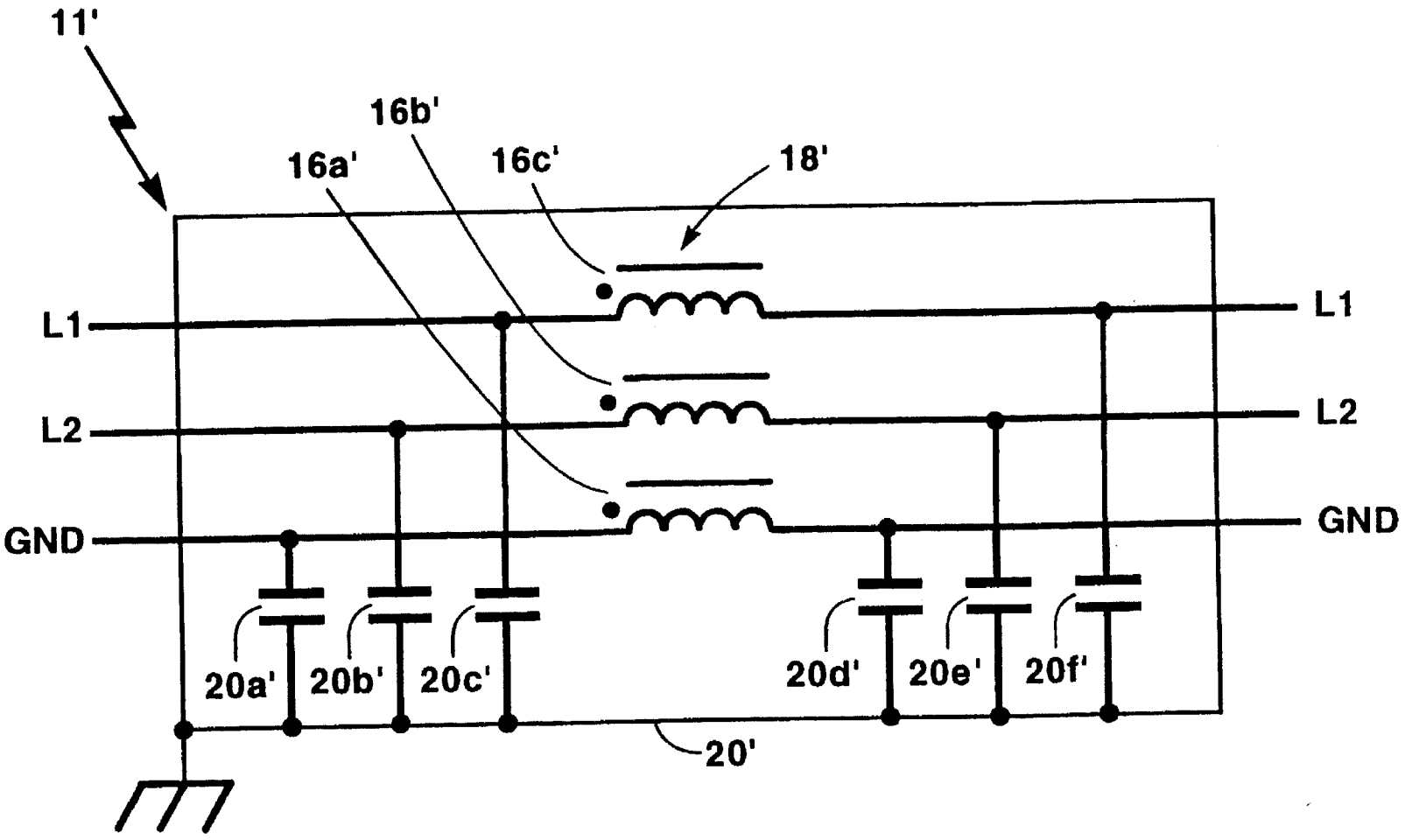
FIG. 2 is a schematic representation of the common-mode filter of FIG. 1.

Referring now to FIG. 2, the equivalent circuit of the filter (FIG. 1) is shown to include a plurality of capacitors 20*a*', 20*b*', 20*c*', 20*d*', 20*e*', and 20*f*' with a plurality of inductors 16*a*', 16*b*', and 16*c*' arranged to provide a two pole low-pass filter 11' for attenuating any noise on the signals lines L1, L2 and GND. An A.C. voltage is introduced into the line side of the three electrical conductors L1, L2 and GND. Any EMI that is present on the electrical conductors is attenuated by the series impedances 16*a*', 16*b*', and 16*c*' produced by the common-mode inductance of the ferrite. The EMI is further filtered by the shunting capacitors 20*a*', 20*b*', 20*c*', 20*d*', 20*e*', and 20*f*' provided by the conductive bracket 20' fitted around the ferrite toroid 18' which is fitted around the A.C. connector.

The filter serves to attenuate EMI by bypassing high frequency currents to the chassis while blocking them from the input lines by means of the comprised capacitors 20*a*', 20*b*', 20*c*', 20*d*', 20*e*', and 20*f*', while the inductors 16*a*', 16*b*', and 16*c*' produced by the common-mode inductance of the ferrite toroid serve to attenuate Radio Frequency (R/F) components superimposed on A.C. currents as the inductor fluxes cancel each other for normal DC currents.

Having described preferred embodiments of the invention it will now become apparent to those of ordinary skill in the art that other embodiments incorporating these concepts may be used. Accordingly it is submitted that the invention should not be limited to the described embodiments but rather should be limited only by the spirit and scope of the appended claims.

What is claimed is:

1. A filter comprising:

a connector comprised of an electrically insulating material having at least two electrical conductors disposed there though;

a body of ferrite material disposed about said connector; and a conductive bracket disposed around said ferrite.

2. The filtering attachment of claim 1 wherein said conductive bracket secures said ferrite about said connector.

3. The filtering attachment of claim 2 wherein said conductive bracket is electrically connected to chassis ground.

4. The filtering attachment of claim 3 wherein said conductive bracket, said ferrite and said connector produce a two pole LC filter.

5. The filtering attachment of claim 4 wherein said conductive bracket secures said ferrite about said connector.

6. An apparatus comprising:

a conductive chassis having a connector, said connector having at least two conductors disposed there through;

a body of ferrite material disposed about said connector; and a conductive bracket disposed around said ferrite.

7. The filter attachment of claim 6 wherein said body of ferrite material has a shape disposed to conform to the shape of said connector.

8. The apparatus of claim 6 further comprising an electrical power cord connected to said connector.

* * * * *